US005997318A

United States Patent [19]

Chou

[11] Patent Number: 5,997,318

[45] Date of Patent: Dec. 7, 1999

[54] STRUCTURE OF AN ELECTRICAL SOCKET

[76] Inventor: Jonie Chou, 9F-4, No. 232, Chung Ho Road, Chung Ho City, Taipei Hsien, Taiwan

[21] Appl. No.: 09/085,663

[22] Filed: May 27, 1998

[51] Int. Cl.[6] ..... H01R 13/44

[52] U.S. Cl. ..... 439/136; 439/136

[58] Field of Search ..... 439/136, 137, 439/145

[56] References Cited

U.S. PATENT DOCUMENTS

| | | | |
|---|---|---|---|
| 2,552,061 | 5/1951 | Popp | 439/136 |
| 4,605,270 | 8/1986 | Aslizadeh | 439/135 |
| 4,729,741 | 3/1988 | Peng | 439/135 |
| 4,768,965 | 9/1988 | Chang | 439/145 |
| 4,952,755 | 8/1990 | Wngel et al. | 439/145 |
| 5,026,299 | 6/1991 | Foulk | 439/136 |

*Primary Examiner*—Kheim Nguyen
*Assistant Examiner*—T C Patel
*Attorney, Agent, or Firm*—Bacon & Thomas

[57] ABSTRACT

An electrical connector includes a faceplate and a cover plate. The faceplate is provided with at least receptacle having two slots. A rectangular recess is provided on the faceplate outside the slots. A tongue of a length corresponding to that of the slots is provided between the slots. Each slot is provided with a slide groove at an outer side thereof. The cover plate is received in the recess and has a length substantially equivalent to the distance from bottom edges of the slots to a bottom edge of the recess. The cover plate includes an indentation at an upper end shaped to receive the tongue, and two side wings each having a hook extending downwardly from outer edges thereof for engaging the slide grooves. When the cover plate is disposed in the recess of the faceplate, the side wings will contact the tongue. When the cover plate is in a use position, the slots are exposed on the faceplate to allow insertion of a plug. When the cover plate is pushed forwardly such that the hooks advance along the slide grooves until the tongue is completely received in the indentation, the side wings will cover the slots respectively to ensure safety and prevent entry of dust into the slots.

7 Claims, 4 Drawing Sheets

STRUCTURE OF AN ELECTRICAL SOCKET

BACKGROUND OF THE INVENTION (a) Field of the Invention

The present invention relates generally to an electrical socket, and more particularly to an improved structure of an electrical socket provided with means to conceal the slots when not in use.

(b) Description of the Prior Art

Slots of electrical sockets are generally exposed on the outside for facility of use, but they pose danger to children, who may insert pointed objects into the slots. Many countries have, therefore, set up strict rules governing the specifications for electrical sockets.

Furthermore, dust and foreign particles may get into the slots of electrical sockets since they are exposed on the outside. Short circuits may result if there is too much dust and dirt inside the slots, which may damage electrical appliances connected thereto or even cause fire. An improved socket structure is therefore necessary.

In U.S. Pat. No. 5,244,398 to the applicant of the present invention, an electrical socket with a safety means is disclosed. The electrical socket taught in said patent includes a Y-shaped elastic division plate between two terminals such that, when a plug is inserted into the socket, an outwardly extending wall at a top portion of the division plate will withdraw due to elasticity to enable electrical connection. Conversely, when the plug is removed, the outwardly extending wall of the division plate will bounce back to seal the slots.

There is also available on the market a safety device for use with electrical sockets. In such a structure, an insulated plate is provided with insulated blades for insertion into slots of the electrical socket. When the electrical socket is not in use, the insulated plate is fitted onto the electrical socket to seal the slots. However, since it is not integrally formed with the electrical socket, it can be easily misplaced.

SUMMARY OF THE INVENTION

A primary object of the present invention is to provide an improved structure of an electrical socket with means to conceal the slots when not in use so that dust or dirt cannot get into the slots and children cannot play with the electrical socket.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

As shown in FIGS. 1–6, the improved structure of an electrical socket according to the present invention essentially comprises a faceplate 1 (3), and a cover plate 2 (4).

Figure 1:
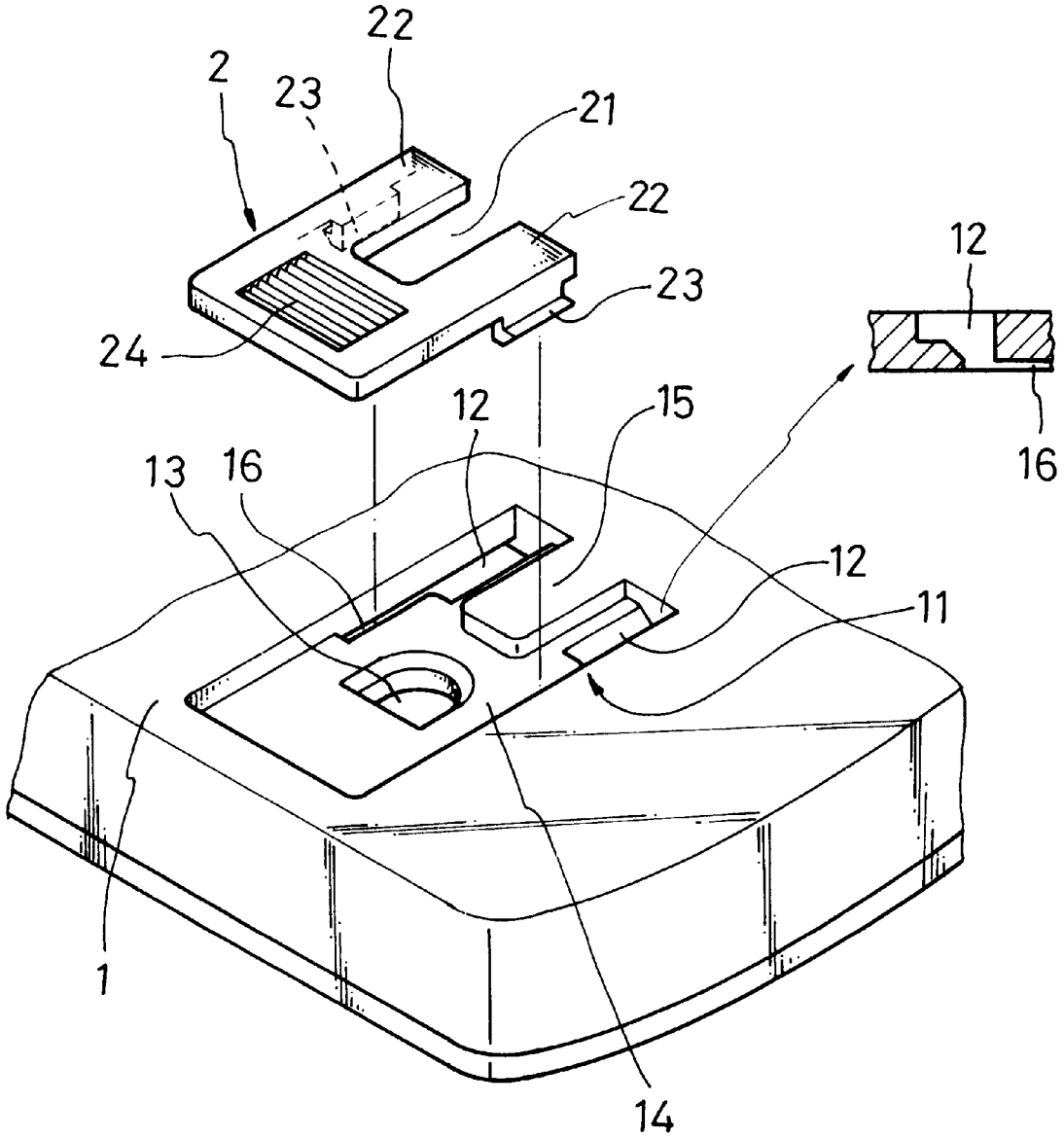
FIG. 1 is a perspective exploded view of a first embodiment of the electrical socket of the present invention.
Figure 2:
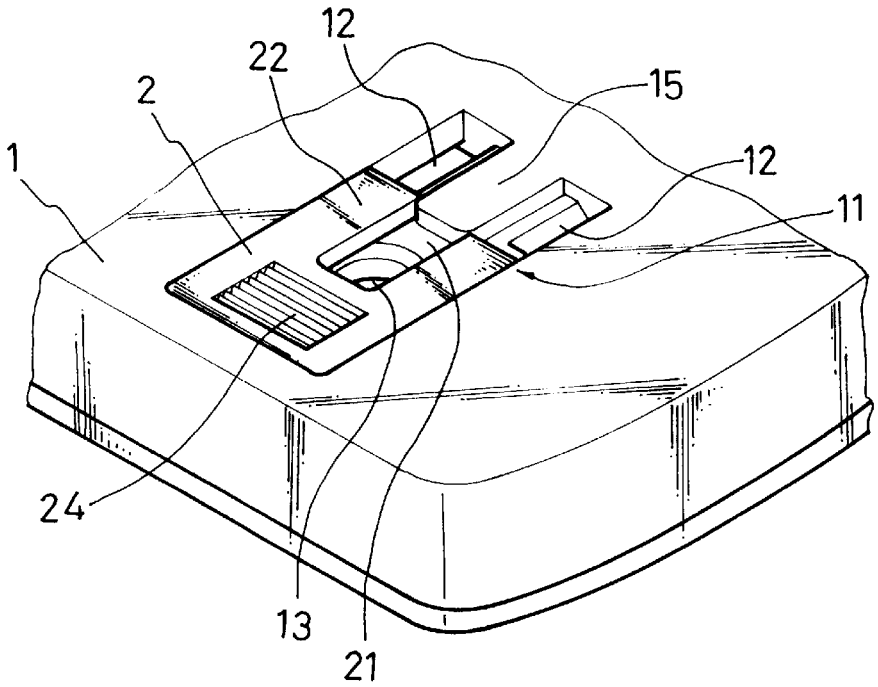
FIG. 2 is a schematic view of the first embodiment of the electrical socket of the present invention when in use.
Figure 3:
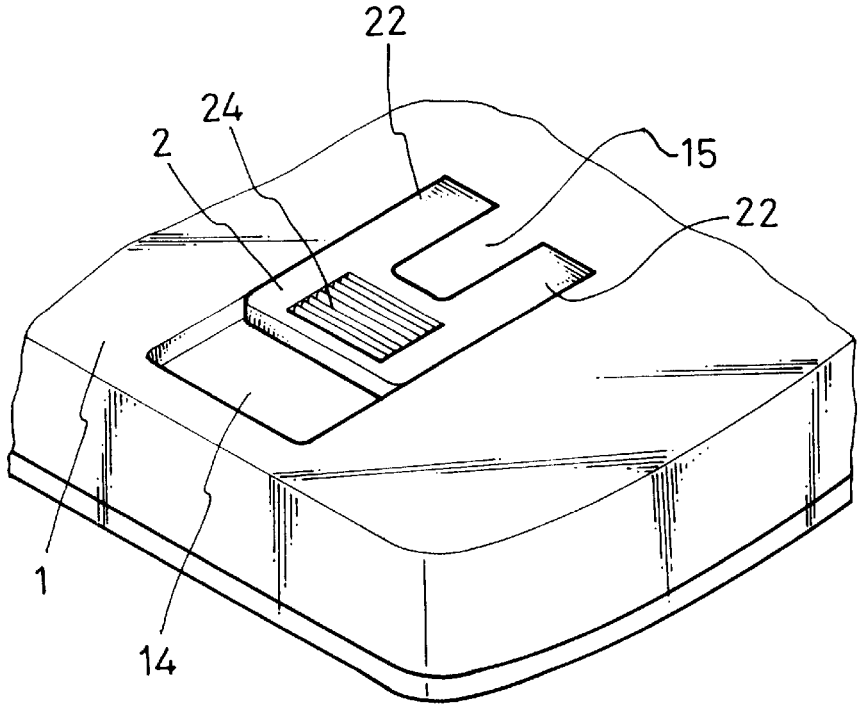
FIG. 3 is a schematic view of the first embodiment of the electrical socket of the present invention showing that the slots are concealed.

FIGS. 1–3 illustrate a first embodiment of the present invention. The faceplate 1 is provided with one or more than one receptacle 11. The receptacle 11 may, in actual practice, include two slots 12 and, optionally, a grounding slot 13 for use with a two-blade plug or a plug with an additional grounding prong. On the faceplate 1 outside the slots 12 there is a rectangular recess 14. A tongue 15 on the same level with the faceplate 1 and having a length equivalent to that of the slots is provided between the slots 12. In this way, the receptacle 11 basically has the shape of a hollowed-out U. Besides, the corresponding outer ends of the slots 12 are respectively provided with a slide groove 16 for engagement with the cover plate 2.

The cover plate 2 is received in the recess 14 of the faceplate 1 and its length corresponds to the distance from bottom edges of the slots 12 to the bottom edge of the recess 14. The cover plate 2 further includes an indentation 21 corresponding to the tongue 15, two side wings 22 at both sides thereof respectively, an outer side of each side wing 22 extending downwardly to form a hook 23, and a threaded portion 24 below the indentation to facilitate pushing or pulling of the cover plate 2 by the use's fingers. The cover plate 2 is inserted in the recess 14 such that the wing 22 at the longer of the two slots 12 touches the tongue 15, as shown in FIG. 2. (As known in the art, since there are positive and negative alternate currents, slots of an electrical socket also differ in length to facilitate correct insertion.) At this point, the slots 12 and the grounding slot 13 are all exposed on the faceplate 1, and an electrical plug may then be plugged in.

Conversely, when the plug is removed, the user may push the cover plate 2 by means of the threaded portion 24 so that the hooks 23 at both sides of the cover plate 2 advance along the slide grooves 16 of the slots 12 until the tongue 15 is entirely received in the indentation 21. At this point, the side wings 22 will completely conceal the slots 12 so that children cannot insert objects into the slots and dust or dirt cannot get into the slots 12. Furthermore, since the cover plate 2 is integrally fitted into the recess 14 of the faceplate 1, it cannot be easily detached from the faceplate 1. In addition, due to the arrangement of the indentation 21 and the tongue 15, the size of the recess 14 can be effectively reduced so that the socket 11 will not be too large. Besides, the grounding prong 13 is in the indentation 21 when in use to allow insertion of a plug with a grounding prong.

Figure 4:
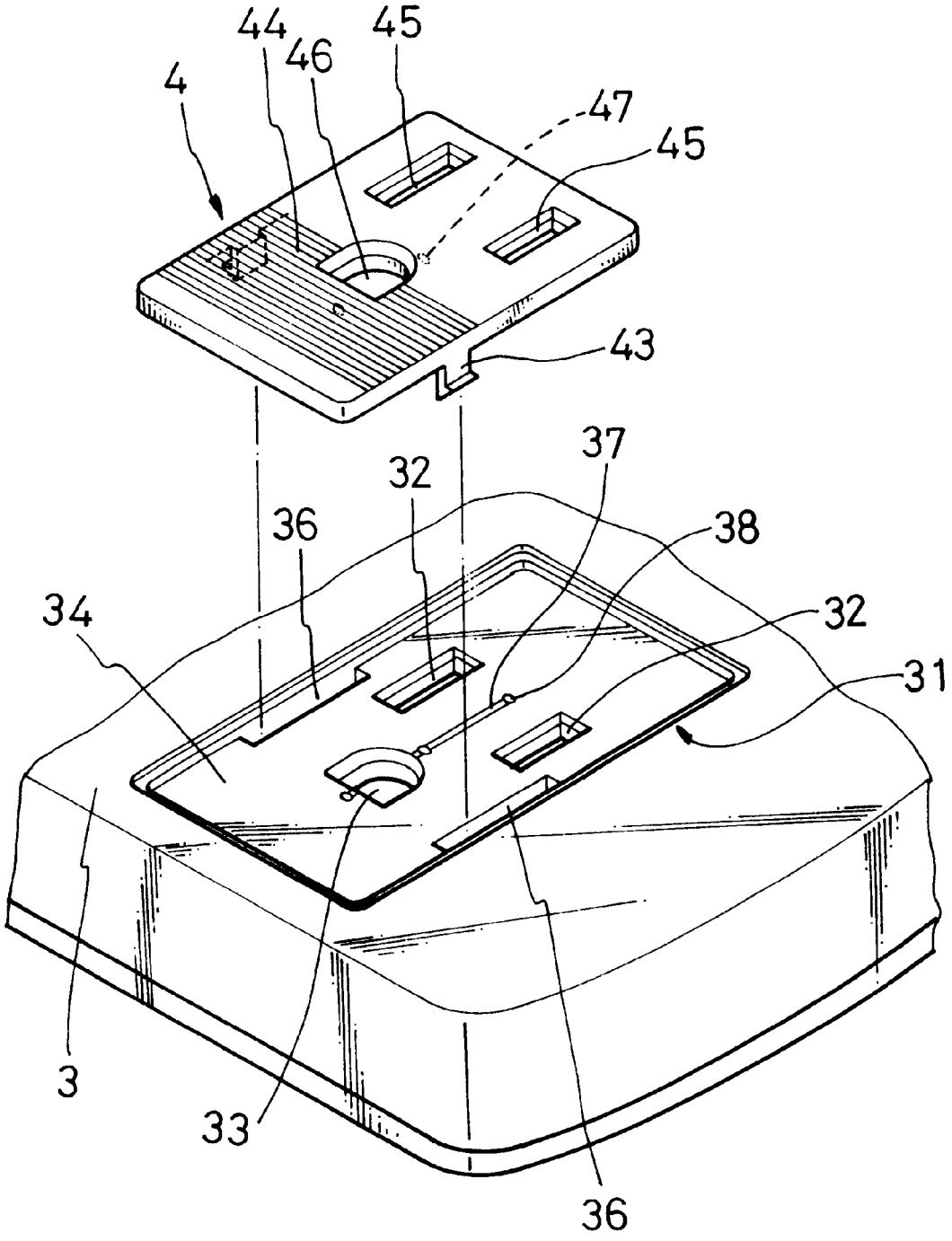
FIG. 4 is a perspective exploded view of a second embodiment of the electrical socket of the present invention.
Figure 5:
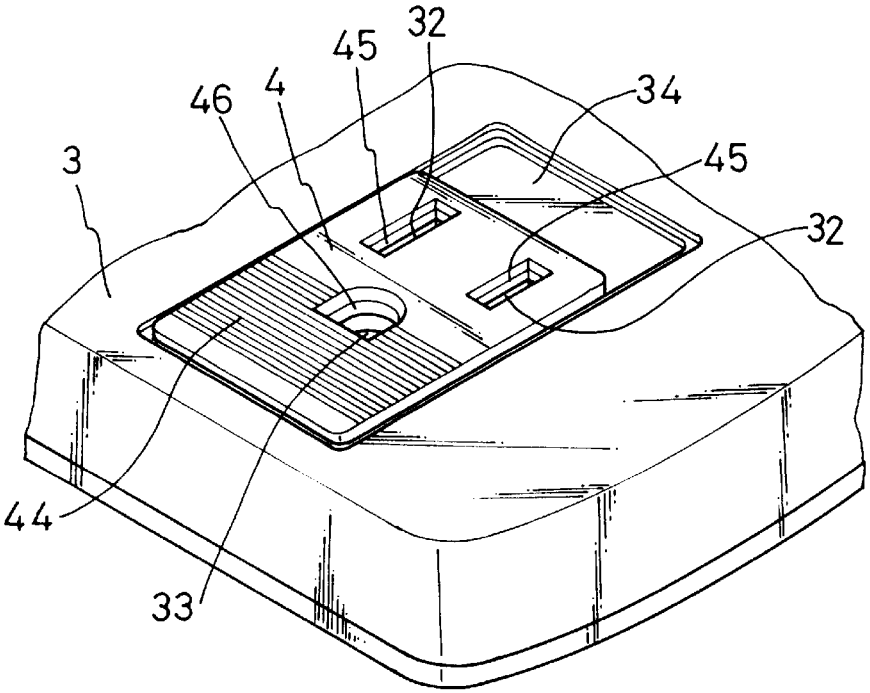
FIG. 5 is a schematic view of the second embodiment of the electrical socket of the present invention when in use.
Figure 6:
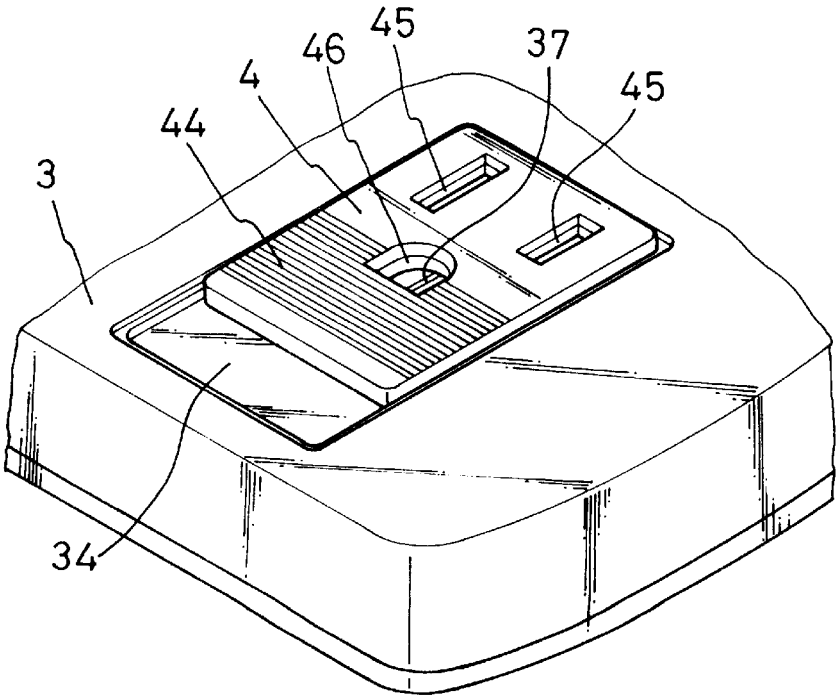
FIG. 6 is a schematic view of the second embodiment of the electrical socket of the present invention showing that the slots are concealed.

FIGS. 4–6 show another embodiment of the present invention. A faceplate 3 is provided with one or more than one receptacle 31, which may, in actual practice, include two slots 32 and, optionally, a grounding slot 33 for use with a two-blade plug or a plug with an additional grounding prong. On the faceplate 1 around the slots 32 and the grounding slot 33 there is a rectangular recess 34, and opposed inner sides of the recess 34 below the slots 32 are respectively provided with slide grooves 36 for engagement with a cover plate 4 to be described hereinafter. Additionally, in order to position the cover plate 4 in the recess 34 during displacement thereof, a groove 37 is provided between the slots 32 and extends to the grounding prong 33, with retaining holes 38 formed at both ends and at the center of the groove 37.

The cover plate 4 is received in the recess 14 of the faceplate 3 and its length corresponds to the distance from top edges of the slots 32 to the bottom edge of the recess 34. The cover plate 4 includes two hooks 43 extending downwardly from both lateral edges thereof respectively to engage the slide grooves 36 of the recess 34 when the cover plate 4 is fitted into the recess 34. The cover plate 4 further includes two upper slots 45 and a lower hole 46 at positions corresponding to the slots 32 and the grounding slot 33. In order to match the retaining holes 38 at the lower end and the center of the groove 37 for positioning purposes, the cover plate 4 is provided with bulges 47 at a bottom side thereof. When the hooks 43 of the cover plate 4 are inserted into the slide grooves 36 of the recess 34, with the cover plate 4 at the bottom edge of the recess 34, as shown in FIG. 5, the slots 32 and the grounding slot 33 of the receptacle 31 are in registration with the upper slots 45 and the lower slot 46 of the cover plate 4 to allow insertion of a plug.

Conversely, when the plug is removed, the user may push the cover plate 4 by means of a pre-formed threaded portion 44 at a lower portion thereof so that the hooks 43 at both sides of the cover plate 4 advance along the slide grooves 36 of the recess 34 until the top edge of the cover plate 4 abuts against the top edge of the recess 34, with the bulges 47 engaging the retaining holes 38 at the upper end and center of the groove 37 to position the cover plate 4 in the recess 34. At this point, the threaded portion 44 of the cover plate 4 will cover up the slots 32 and the grounding slot 33 of the receptacle 31 to prevent entry of dust or insertion of a plug or other pointed objects. Furthermore, since the cover plate 4 is integrally fitted into the recess 34 of the faceplate 3, it cannot be easily detached therefrom. In addition, since the cover plate 4 is provided with upper slots 45 and a lower slot 46 to match the slots 32 and the grounding slot 33, the size of the receptacle 31 will not be too large. In actual practice, the receptacle 31 may or may not be provided with the grounding prong 33, and the cover plate 4, correspondingly, may or may not be provided with the lower slot 46 to enable the electrical socket of this embodiment to be adapted for use with a two-blade plug or a plug with an additional grounding prong.

Although the present invention has been illustrated and with reference to the preferred embodiment thereof, it should be understood that it is in no way limited to the details of such embodiment but is capable of numerous modifications within the scope of the appended claims.

What is claimed is:

1. A structure of an electrical socket, comprising:

a faceplate provided with one or more than one receptacle, said receptacle being provided with two slots, a rectangular recess being formed on said faceplate outside of said slots, and a tongue being provided between said slots corresponding to the length of said slots, said slots being each provided with a slide groove at an outer side thereof; and a cover plate being received in said recess of said receptacle and having a length substantially corresponding to the distance from bottom edges of said slots to a bottom edge of said recess, said cover plate including an indentation at an upper end shaped and sized to match and receive said tongue and two side wings each of which extends downwardly to form a hook for engaging the corresponding slide groove, said cover plate being disposed in said recess such that said side wings at said slots touch said tongue;

whereby when said cover plate is not pushed, said slots of said receptacle are exposed on said faceplate to allow insertion of a plug, and when said cover plate is pushed so that said hooks at both sides thereof slide forwardly along said slide grooves until said indentation completely receives said tongue with said side wings concealing said slots, thereby achieving a safety electrical socket.

2. A structure of an electrical socket as defined in claim 1, wherein said receptacle further includes a grounding slot below said slots, said grounding slot being located in said indentation when said cover plate is not pushed and being concealed by said cover plate when said cover plate is pushed forwardly in said recess.

3. A structure of an electrical socket as defined in claim 1, wherein said cover plate further includes a threaded portion to facilitate pushing of said cover plate by fingers.

4. A structure of an electrical socket, comprising:

a faceplate being provided with one or more than one receptacle, said receptacle being provided with two slots, a rectangular recess being formed on said faceplate outside of said slots, said recess being provided with two slide grooves at opposed outer sides below said slots respectively; and a cover plate received in said recess and having a length corresponding to the distance from top edges of said slots to a bottom edge of said recess, said cover plate including two hooks extending downwardly from both lateral sides thereof to correspond to said slide grooves of said recess, whereby said hooks may be inserted into said slide grooves when said cover plate is disposed in said recess, said coverplate further including two cover slots corresponding to said slots of said receptacle;

whereby when said cover plate is not pushed, said cover slots of said recess are in registration with said slots of said receptacle to allow insertion of a plug, and when said cover plate is pushed such that said hooks thereof advance along said slide grooves until a top edge of said cover plate abuts against a top edge of said recess, said slots are concealed, wherein a groove is provided between said slots of said receptacle, said groove being provided with respective retaining holes at both ends and the middle thereof, and said cover plate is providing with bulges at a bottom side thereof corresponding to adjacent retaining holes of said groove to facilitate positioning of said cover plate during displacement.

5. A structure of an electrical connector as defined in claim 4, wherein said receptacle further includes a grounding slot below said two slots, and said cover plate further includes a lower slot below said two cover slots to match said grounding slot, said grounding slot being in register with said lower slot of said cover plate when said cover plate is not pushed forwardly but being concealed by said cover plate when said cover plate is pushed.

6. A structure of an electrical socket as defined in claim 4, wherein said cover plate further includes a threaded portion to facilitate pushing of said cover plate by fingers.

7. A structure of an electrical socket as claimed in claim 5, wherein said groove extends to said grounding slot.

* * * * *